US008770876B2

(12) United States Patent
Fukusada et al.

(10) Patent No.: US 8,770,876 B2
(45) Date of Patent: Jul. 8, 2014

(54) CONVEYANCE SPEED CONTROL IN A PRINTING APPARATUS

(75) Inventors: Yuki Fukusada, Aichi (JP); Tetsuya Okano, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 235 days.

(21) Appl. No.: 13/248,606

(22) Filed: Sep. 29, 2011

(65) Prior Publication Data

US 2012/0134731 A1 May 31, 2012

(30) Foreign Application Priority Data

Nov. 29, 2010 (JP) ..... 2010-265735

(51) Int. Cl.
*B41J 11/00* (2006.01)
*B65H 5/26* (2006.01)
*B65H 7/02* (2006.01)

(52) U.S. Cl.
USPC ..... 400/582; 399/397; 399/401; 271/9.02; 271/258.01

(58) Field of Classification Search
USPC ..... 400/582
See application file for complete search history.

(56) References Cited

U.S. PATENT DOCUMENTS 4,392,740 A * 7/1983 Ito et al. ..... 399/392
4,672,465 A 6/1987 Ono
4,796,055 A * 1/1989 Takano et al. ..... 399/392
5,651,538 A * 7/1997 Chung et al. ..... 271/9.02
6,650,436 B1 * 11/2003 Hamamoto et al. ..... 271/270
7,313,355 B2 * 12/2007 Isobe et al. ..... 399/341
7,520,586 B2 4/2009 Itoh
8,182,058 B2 5/2012 Itoh
8,238,766 B2 * 8/2012 Okano ..... 271/258.01
2004/0179053 A1 9/2004 Itoh
2008/0067732 A1 * 3/2008 Matsushima ..... 399/130
2009/0087237 A1 4/2009 Sato (Continued)

FOREIGN PATENT DOCUMENTS

CN 100410159 C 8/2008
JP 6121674 A 1/1986

(Continued)

OTHER PUBLICATIONS

Notification of Reasons for Rejection issued in Japanese Counterpart Application No. 2010-265735, mailed Jan. 8, 2013.

(Continued)

*Primary Examiner* — Jill Culler
(74) *Attorney, Agent, or Firm* — Banner & Witcoff, Ltd.

(57) ABSTRACT

A printing apparatus is provided. The printing apparatus includes a printing unit, a sheet feeder, a discharge unit, a sheet path including a feeding path, a discharge path, and a reversing path, a manual sheet inlet, through which a recording sheet is manually inserted, a manual sheet path merging into the sheet path at a merging point and guiding the manually-inserted recording sheet to the merging point, a detecting unit to detect the manually-inserted sheet fed through the manual sheet inlet while a double-face printing operation is conducted with a preceding recording sheet, a judging unit to judge whether the detecting unit detected the manually-inserted sheet, and a conveyer controller unit to reduce a speed to convey the preceding recording sheet in the sheet path when the judging unit judges that the detecting unit detected the manually-inserted sheet.

11 Claims, 9 Drawing Sheets

(56) References Cited

U.S. PATENT DOCUMENTS

| | | | |
|---|---|---|---|
| 2009/0195584 | A1 | 8/2009 | Itoh |
| 2010/0129094 | A1 | 5/2010 | Maeda et al. |
| 2011/0097129 | A1 | 4/2011 | Hashimoto |

FOREIGN PATENT DOCUMENTS

| | | | |
|---|---|---|---|
| JP | 4-246036 | A | 9/1992 |
| JP | 6-089052 | A | 3/1994 |
| JP | 3157912 | B2 | 4/2001 |
| JP | 2004276264 | A | 10/2004 |
| JP | 2005-219860 | | 8/2005 |
| JP | 2007-076782 | | 3/2007 |
| JP | 2009-046303 | A | 3/2009 |
| JP | 2009-086506 | | 4/2009 |
| JP | 2011-093160 | | 5/2011 |

OTHER PUBLICATIONS

Chinese Office Action dated Dec. 23, 2013 in corresponding Chinese Application No. 201110323799.4.

* cited by examiner

CONVEYANCE SPEED CONTROL IN A PRINTING APPARATUS

CROSS REFERENCE TO RELATED APPLICATION

This application claims priority from Japanese Patent Application No. 2010-265735, filed on Nov. 29, 2010, the entire subject matter of which is incorporated herein by reference.

BACKGROUND

1. Technical Field

An aspect of the present invention relates to a printing apparatus capable of printing images on either side of a recording sheet. More specifically, the present invention relates to a double-face printable printing apparatus having a sheet path, along which a recording sheet fed manually by a user is guided to a printing unit.

2. Related Art

A printing apparatus capable of "double-face printing," i.e., printing an image on an either or both sides of a recording sheet, is known. The printing apparatus may have a sheet-reversing path, in which the recording sheet with an image printed on one side is turned over, so that another image can be printed on the other side of the recording sheet. Meanwhile, a printing apparatus having a manual sheet path to convey a manually-fed recording sheet is known. Further, a printing apparatus, which has both of the double-face printing function and the manual sheet path, is known.

SUMMARY

In the printing apparatus with the double-face printing function and the manual sheet path, a recording sheet may be manually inserted in the manual sheet path by a user whilst the printing apparatus is conducting a double-face printing operation with a recording sheet having been loaded in the printing apparatus earlier. However, behaviors of the printing apparatus in such a case, in which the preceding recording sheet conveyed in the sheet-reversing path and the manually-inserted recording sheet may collide, are yet to be considered. For example, when the collision does occur, the collided recording sheets may be jammed inside the printing apparatus, and the user may be required to remove the collided recording sheets.

In view of such consideration, the present invention is advantageous in providing a printing apparatus, which reduces burden for the user when the recording sheet is manually inserted whilst the printing apparatus is in a double-face printing operation.

According to an aspect of the present invention, a printing apparatus, which is capable of double-face printing to print images on both of two sides of a recording sheet, is provided. The printing apparatus includes a printing unit, which is configured to print an image on one of the two sides of the recording sheet, a sheet feeder, which is configured to feed the recording sheet to the printing unit, a discharge unit, in which the recording sheet with the image printed thereon is settled, a sheet path, which includes a feeding path to guide the recording sheet fed from the sheet feeder to the printing unit, a discharge path to guide the recording sheet passing through the printing unit to the discharge unit, and a reversing path diverging from the discharge path and merging into the feeding path at an upstream position with respect to the printing unit along a direction of conveying the recording sheet, the sheet path guiding the recording sheet therealong and reversing the recording sheet by use of the reversing path during a double-face printing operation, a manual sheet inlet, through which a recording sheet is manually inserted in the printing apparatus by a user, a manual sheet path, which is configured to merge into the sheet path at a merging point being in an upstream position with respect to the printing unit along the direction of conveying the recording sheet and guide the manually-inserted recording sheet to the merging point, a detecting unit, which is configured to detect the manually-inserted sheet fed through the manual sheet inlet whilst the double-face printing operation is conducted with a preceding recording sheet, a judging unit, which is configured to judge as to whether the detecting unit detected the manually-inserted sheet, and a conveyer controller unit, which is configured to reduce a speed to convey the preceding recording sheet in the sheet path when the judging unit judges that the detecting unit detected the manually-inserted sheet.

According to another aspect of the present invention, a printing apparatus, which is configured to print an image on a recording sheet, is provided. The printing apparatus includes a sheet storage, which is configured to store the recording sheet, a printing unit, which is configured to print an image on one of two sides of the recording sheet, a pick-up unit, which is configured to pick up the recording sheet from the sheet storage, a discharge unit, which is configured to discharge the recording sheet, a conveyer, which includes a first conveyer configured to convey the recording sheet picked up from the sheet storage by the pick-up unit to the printing unit; a second conveyer configured to convey the recording sheet passing through the printing unit to the discharge unit; and a reversing conveyer configured to diverge from the second conveyer and merge into the first conveyer at a merging point, and conveys the recording sheet and reversing the recording sheet by use of the reversing conveyer during a double-face printing operation, a sheet inlet, which is configured to receive a different recording sheet inserted in the printing apparatus, a third conveyer, which is configured to merge into the first conveyer at the merging point and to convey the different recording sheet from the sheet inlet to the merging point, a detector, which is configured to detect the different recording sheet being fed through the sheet inlet, and a conveyer controller, which is configured to reduce a speed to convey the recording sheet in the conveyer if the detector detects the different recording sheet being inserted into the sheet inlet while the conveyer is conveying the recording sheet.

BRIEF DESCRIPTION OF THE ACCOMPANYING DRAWINGS

DETAILED DESCRIPTION

Hereinafter, embodiments of the present invention will be described with reference to the accompanying drawings. A printer 100 is a printing apparatus, which has a double-face printing function and a manual sheet path for conveying a manually fed recording sheet.

Overall Configuration of Printer

Figure 1:
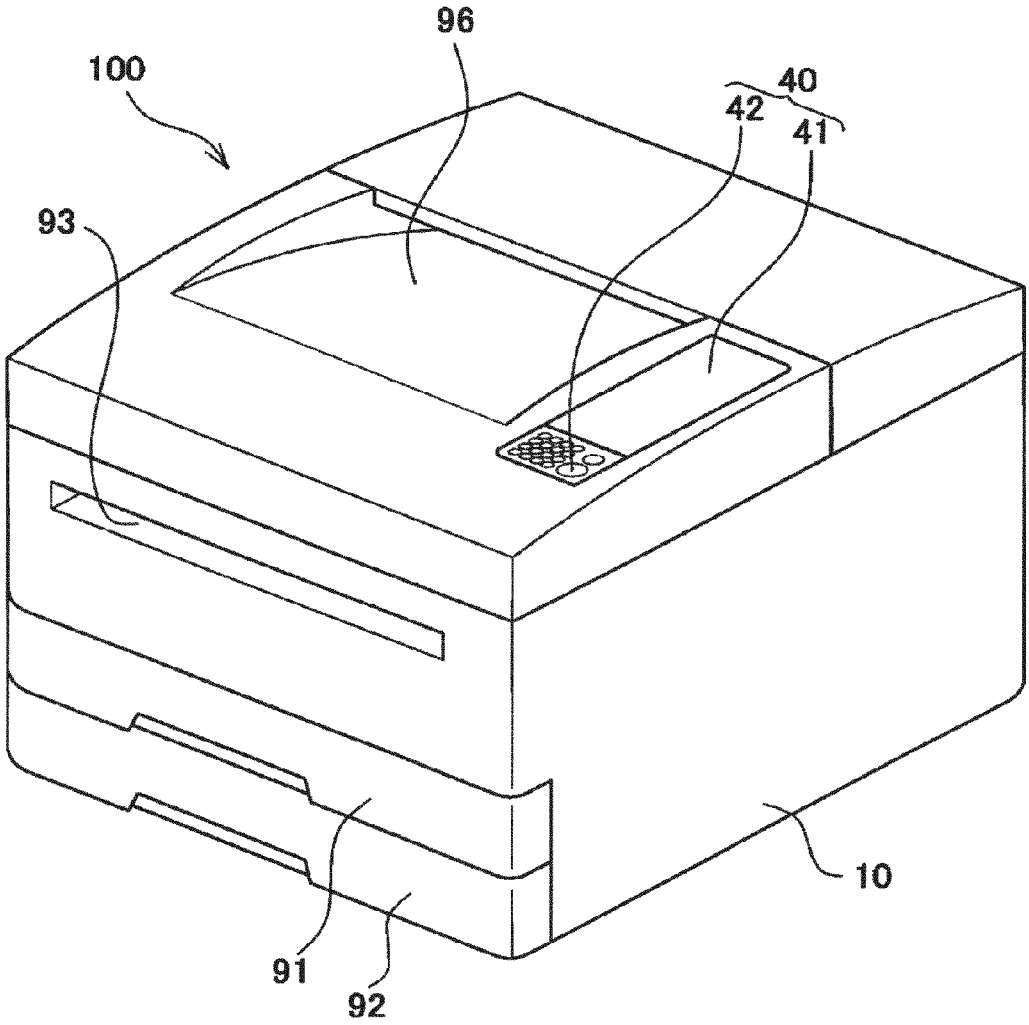
FIG. 1 is a perspective view of a printer according to embodiments of the present invention.

The printer 100 (see FIG. 1) according to the present embodiment includes a main unit 10, which forms an image on a surface of a recording sheet, a display unit 41 including a liquid crystal display, and an operation panel 40, through which information concerning operations of the printer 100 is displayed and user's input is entered. The operation panel 40 includes buttons 42 such as a start key, a stop key, and numerical keys (not shown).

The main unit 10 is arranged in a lower section of the printer 100 and includes sheet cassettes 91, 92, a discharge tray 96, and a manual sheet inlet 93. The sheet cassettes 91, 92 are installable in and removable from the printer 100 and stores unused recording sheets therein. The discharge tray 96 is arranged in a top section of the printer 100. The recording sheets with images formed thereon are discharged out of the main unit 10 and settled in the discharge tray 96. The manual sheet inlet 93 is an opening, through which a user manually inserts the recording sheet in the main unit 10.

Internal Configuration of the Printer

Figure 2:
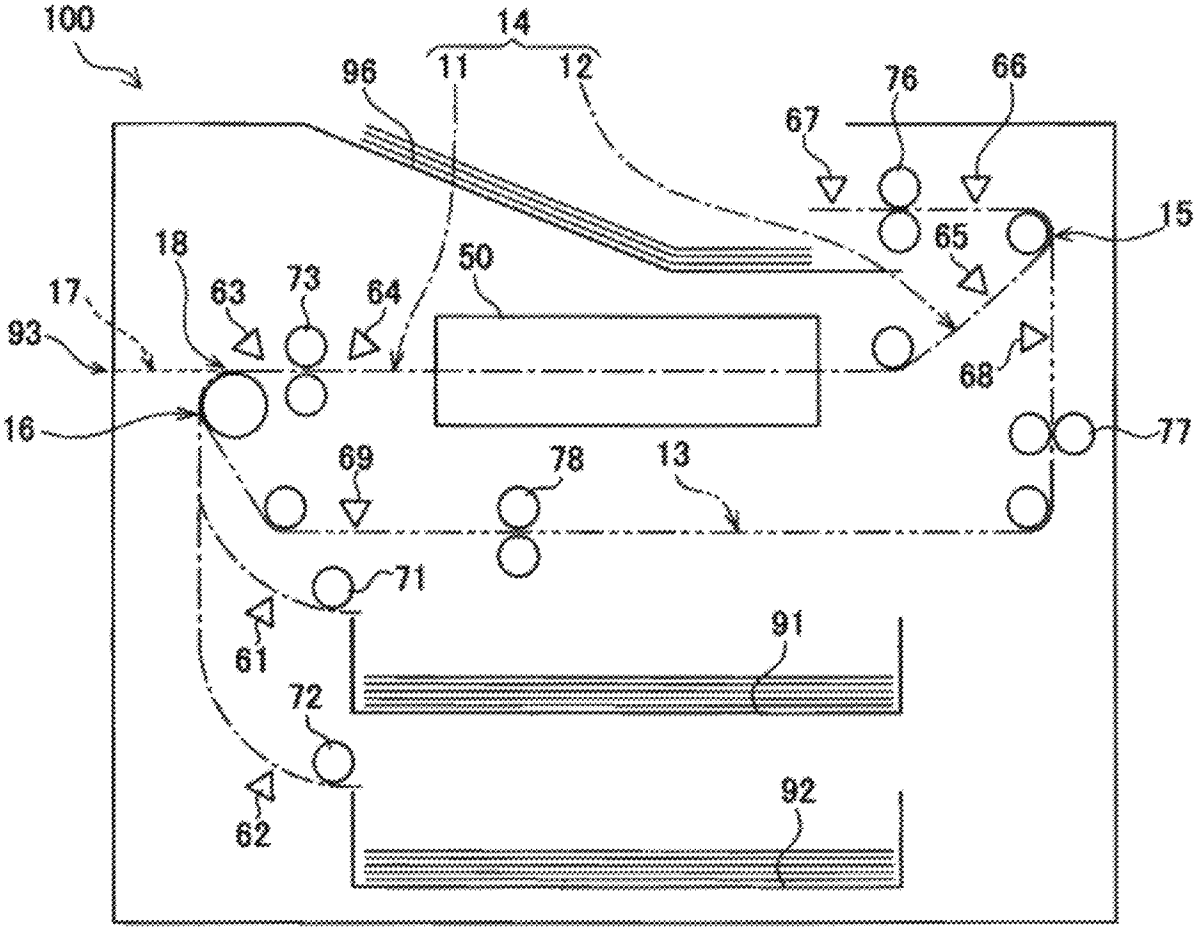
FIG. 2 is a schematic diagram to illustrate an internal configuration of the printer according to the embodiments of the present invention.

The printer 100 includes a processing unit 50 (see FIG. 2), which forms a toner image in a known electro-photographic laser-printing method and transfers the toner image onto a surface of the recording sheet. The processing unit 50 may or may not be a laser-printing unit but may be, for example, an inkjet-printing unit. Further, the printer 100 may or may not necessarily be a color printer but may be, for example, a monochrome printer.

The printer 100 includes feed rollers 71, 72, a register roller 73, and a discharge roller 76. The feed roller 71 picks up the recording sheets stored in the sheet cassette 91 one-by-one, and the feed roller 72 picks up the recording sheets stored in the sheet cassette 92 one-by-one. The register roller 73 conveys the recording sheet to the processing unit 50. The discharge roller 76 conveys the recording sheet to the discharge tray 96. Further, the printer 100 includes a plurality of conveyer rollers, including conveyer rollers 77, 78, along sheet paths. The discharge roller 76 is rotatable in two different (normal and reverse) directions. The register roller 73, the conveyer rollers 77, 78 are rotatable in a single (normal) direction.

In the printer 100, a feeding path 11, in which the recording sheet picked up from the sheet cassette 91/92 by the feed roller 71/72 is guided through the register roller 73 to the processing unit 50, are arranged. Further, in the printer 100, a discharge path 12, in which the recording sheet is guided from the processing unit 50 through the discharge roller 76 to the discharge tray 96, is arranged. The feeding path 11, from the sheet cassette 91/92 to the processing unit 50, and the discharge path 12, from the processing unit 50 to the discharge roller 76, is arranged to have a cross-sectional shape similar to a "U," and a printing path 14 including the feeding path 11 and the discharge path 12 has a cross-sectional shape similar to an "S." The printing path 14 is indicated in dash-and-dot lines in FIG. 2.

In the printer 100 according to the present embodiment, the recording sheets stored in the sheet cassette 91/92 are picked up one-by-one and fed in the feeding path 11. The recording sheets are conveyed to the processing unit 50, in which the toner image is transferred onto the surface of the recording sheet. The recording sheet with the transferred toner image is forwarded to a fixing device (not shown) in the processing unit 50, and the toner image is thermally fixed on the surface of the recording sheet. The recording sheet with the fixed image is carried in the discharge path 12 to the discharge roller 76, which ejects the recording sheet out of the main unit 10. The ejected recording sheet is settled in the discharge tray 96.

The printer 100 has a structure to turn over the recording sheet in order to print an image even on a reversed side of the recording sheet. More specifically, the printer 100 is capable of printing a first image on one side (a first side) of the recording sheet, turning over the recording sheet after the first image is printed on the first side, and printing a second image on the other side (a second side) of the same recording sheet. The recording sheet with the first image printed on the first side is turned over in a reversing path 13 and returned to the processing unit 50 with the second side facing the processing unit 50. The reversing path 13 is indicated in a double-dotted line in FIG. 2.

The reversing path 13 is arranged to diverge from the discharge path 12 at a branch point 15, which is in a lower-stream position with respect to the processing unit 50 and in an upper-steam position with respect to the discharge roller 76 along a direction of a flow of the recording sheet being conveyed. The reversing path 13 diverged from the branch point 15 extends in a position between the processing unit 50 and the sheet cassette 91 and merges into the printing path 14 at a merging point 16, which is in a lower-stream position with respect to the feed rollers 71, 72 in the feeding paths 11 and in an upper-stream position with respect to the register roller 73. Thus, paths for the recording sheet in the printer 100 include the printing path 14 and the reversing path 13.

A flow of the recording sheet being conveyed in the printer 100 during a double-face printing operation will be described below. Firstly, the recording sheet being picked up from the sheet tray 91/92 is carried in the feeding path 11 to the processing unit 50. The first image is formed on the first side of the recording sheet in the processing unit 50. Secondly, the recording sheet with the first image printed on the first side is carried in the discharge path 12 to the discharge roller 76. Thirdly, when the recording sheet reaches the discharge roller 76 and a rear end of the recording sheet passes through the branch point 15, rotation of the discharge roller 76 in a normal direction is stopped with the recording sheet being nipped between the discharge roller 76 and a paired roller (unsigned). Fourthly, a rotating direction of the discharge roller 76 is switched, and the discharge roller 76 rotates in a reverse direction. Fifthly, according to the reverse rotation of the discharge roller 76, the recording sheet is conveyed in the reverse direction in the reversing path 13 via the branch point 15. Sixthly, the recording sheet is returned to the feeding path 11 via the merging point 16, which is in the upper-stream position with respect to the processing unit 50. Thus, the recording sheet is turned over to have the second side facing the processing unit 50 when the recording sheet is carried to the processing unit 50. Seventhly, the second image is printed on the second side of the recording sheet in the processing unit 50. Finally, the recording sheet with the second image printed on the second side is discharged by the discharge roller 76 and settled in the discharge tray 96.

The printer 100 is further provided with a structure for manual sheet-feeding, which conveys a recording sheet manually fed by a user in a manual sheet path 17 in the printer 100. The manual sheet path 17, indicated in a broken line in FIG. 2, guides the manually-inserted recording sheet through the manual sheet inlet 93 to the feeding path 11 via the merging point 18. That is, the manual sheet path 17 ranges from the manual sheet inlet 93, which is a most upstream point, to the merging point 18, which is a most downstream point. The merging point 18 is in an upper-stream position with respect to the register roller 73 and a lower-stream position with respect to the feed rollers 71, 72 in the feeding path 11.

A flow of the manually-inserted recording sheet being conveyed in the printer 100 during a printing operation will be described below. Firstly, the recording sheet is inserted through the manual sheet inlet 93 by the user. The manually-inserted recording sheet is forwarded by the user along the manual sheet path 17 to the feeding path 11. When the manually-inserted recording sheet reaches the register roller 73, the register roller 73 nips the manually-inserted recording sheet in cooperation with a paired roller (unsigned) and stands by. Secondly, when the processing unit 50 is prepared for printing an image, the register roller 73 is rotated, and the manually-inserted recording sheet is carried in the feeding path 11 to be automatically drawn in the printer 100. Thirdly, when the manually-inserted recording sheet reaches the processing unit 50, the image is printed on a surface of the manually inserted recording sheet in the processing unit 50. Thus, until the register roller 73 nips the manually-inserted recording sheet, the user holds and forwards the manually-inserted recording sheet in the manual sheet path 17. Once the register roller 73 nips the manually-inserted recording sheet, the manually-inserted recording sheet is automatically carried in the feeding path 11. It is to be noted that images may be formed on the first and second sides of the manually-inserted recording sheet, similarly to the recording sheet fed from the sheet cassette 91, 92, once the manually-inserted recording sheet is drawn automatically in the printer 100.

The printer 100 includes sheet sensors 61-69, which are arranged along the sheet paths 13, 14, 17. The sheet sensors 61-64 are arranged along the feeding path 11. More specifically, the sheet sensor 61 and the sheet sensor 62 are arranged in immediate downstream positions with respect to the feed roller 71 and the feed roller 72 respectively. The sheet sensor 63 is arranged in an immediate upstream position with respect to the register roller 73, and the sheet sensor 64 is arranged in an immediate downstream position with respect to the register roller 73. The sheet sensors 65-67 are arranged along the discharge path 12. More specifically, the sheet sensor 65 is arranged in an immediate upstream position with respect to the branch point 15, the sheet sensor 66 is arranged in an immediate upstream position with respect to the discharge roller 76 with reference to the flow of the recording sheet being conveyed in the normal direction. The sheet sensor 67 is arranged in an immediate downstream position with respect to the discharge roller 76 with reference to the flow of the recording sheet being carried in the normal direction. Further, the sheet sensors 68, 69 are arranged along the reversing path 13. More specifically, the sheet sensor 68 is arranged in an immediate upstream position with respect to the conveyer roller 77, which is in a position closest to the branch point 15 amongst the plurality of conveyer rollers 77, 78. The sheet sensor 69 is arranged in a lower-stream position with respect to the sheet sensor 68 with reference to the flow of the recording sheet being conveyed in the reversing path 13.

Each of the sheet sensors 61-69 detects presence of the recording sheet entering a detectable range thereof and changes output signals when the recording sheet entering the detectable range is detected. Therefore, when the signals from the sheet sensors 61-69 change, that is, when signals indicating absence of the recording sheet are switched to signals indicating presence of the recording sheet, the front end of the recording sheet reaching the detectable range is detected. When the signals indicating presence of the recording sheet are switched to the signals indicating absence of the recording sheet, the rear end of the recording sheet passing through and exiting the detectable range is detected.

Additionally to detection of the front end of the recording sheet, signals output from the sheet sensors 61, 62 can be referred to in order to detect a length of the recording sheet being carried in the feeding path 11. The length of the recording sheet may be obtained, for example, based on a length of a time period between detection of the front end and detection of the rear end of the recording sheet at the sheet sensor 61 and a speed to carry the recording sheet, which is obtained based on a rotation speed of the feed roller 71.

The sheet sensor 63 can detect the manually-inserted recording sheet having been inserted in the manual sheet path 17 at the earliest amongst the sheet sensors 61-69. Therefore, signals output from the sheet sensor 63 can be referred to in order to detect the manually-inserted recording sheet having been inserted. The sheet sensor 63 may be referred to as a "pre-register sensor 63" hereinbelow. Meanwhile, signals output from the sheet sensor 64 can be used to determine timings to start feeding the recording sheet to the processing unit 50 and to start forming an image in the processing unit 50. The sheet sensor 64 may be referred to as a "post-register sensor 64" hereinbelow.

It is to be noted that a quantity and arrangement of the sheet sensor are not limited to those described above but may be modified arbitrarily. For example, a greater quantity of the sheet sensors may enable to detect an accurate position of a sheet jam, when occurs, in the sheet paths. For example, on the other hand, a smaller quantity of the sheet sensors may enable manufacturing cost for the printers to be reduced.

Electrical Configuration of the Printer

Figure 3:
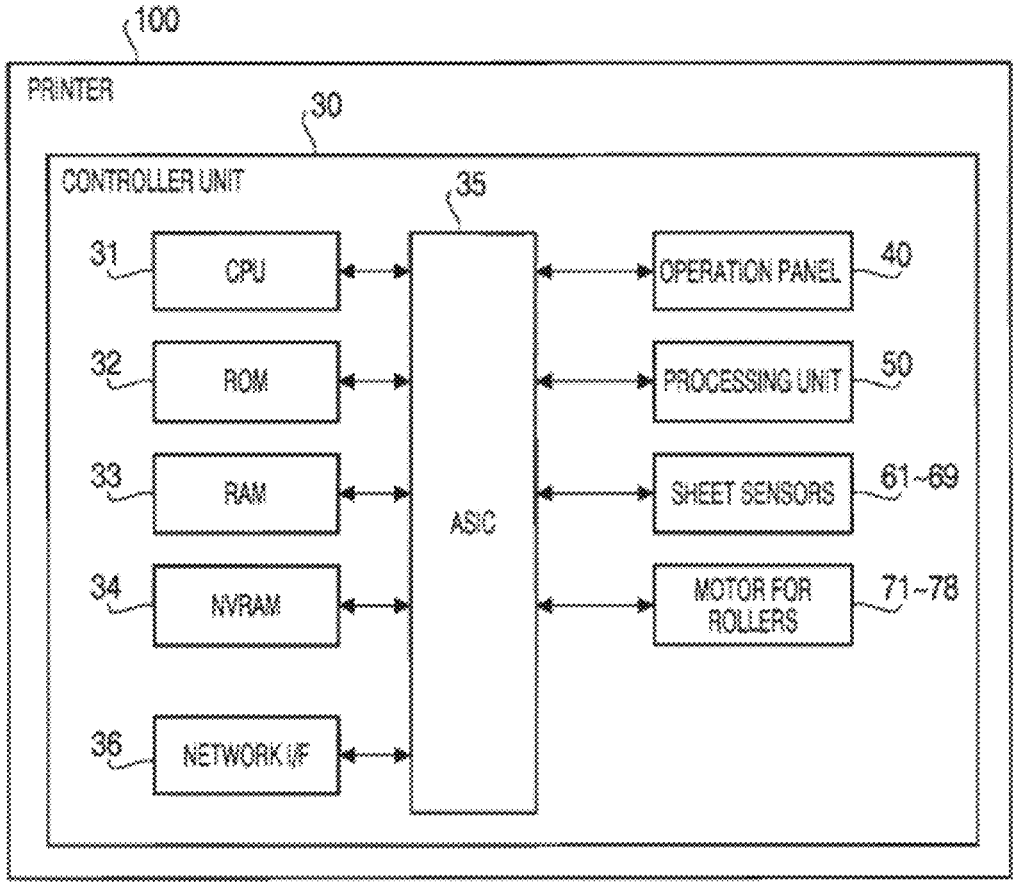
FIG. 3 is a block diagram to illustrate an electrical configuration of the printer according to the embodiments of the present invention.

The electrical configuration of the printer 100 will be described (see FIG. 3). The printer 100 is provided with a controller unit 30, which includes a CPU 31, a ROM 32, a RAM 33, a non-volatile RAM (NVRAM) 34, an ASIC 35, and a network interface (I/F) 36. The controller unit 30 is electrically connected with the processing unit 50, the operation panels 40, the sheet sensors 61-69, and a motor to drive the conveyer rollers 71-78. The rollers 71-78 may be driven commonly by a motor. Alternatively, a plurality of motors may be provided, and the rollers 71-78 may be driven individually.

The CPU 31 is an arithmetic processor, which processes information to be used to achieve functionalities of the printer 100 including image forming. The ROM 32 stores programs to control the printer 100 and information concerning operation settings and initial settings of the printer 100. The RAM 33 serves as a work area, in which the controlling programs are loaded, and a memory area, in which image data is temporarily stored. The NVRAM 34 is a data storage, in which information concerning operation settings and image data can be stored.

The CPU 31 controls behaviors of the printer 100 through the ASIC 35. In particular, the CPU 31 processes information from the controlling programs and signals obtained from various sensors and stores the information in the RAM 33 and the NVRAM 34 to drive components in the printer 100. The CPU 31 controls, for example, timing for emitting light from an exposure device, and activation of the motor to drive the rollers 71-78.

The network I/F 36 connects the printer 100 with networks, such as a local area network (LAN), to establish communication with other external devices (e.g., personal computer) through the network. The printer 100 can be supplied with print jobs through the network I/F 36.

Double-Face Printing Operation (First Example)

Behaviors of the printer 100 in a double-face printing operation according to a first embodiment of the present invention will be described with reference to flowcharts shown in FIGS. 4, 5, 6, and 7. The flows of double-face printing operation may be controlled and executed by the controller unit 30 upon, for example, receipt of a print job for double-face printing, which is transmitted from an external device. In the print job described below, an image is formed on a recording sheet supplied from the sheet cassette 91; however, a recording sheet supplied from the sheet cassette 92 or other additional sheet cassette (not shown) may be similarly handled in the printer 100.

Figure 4:
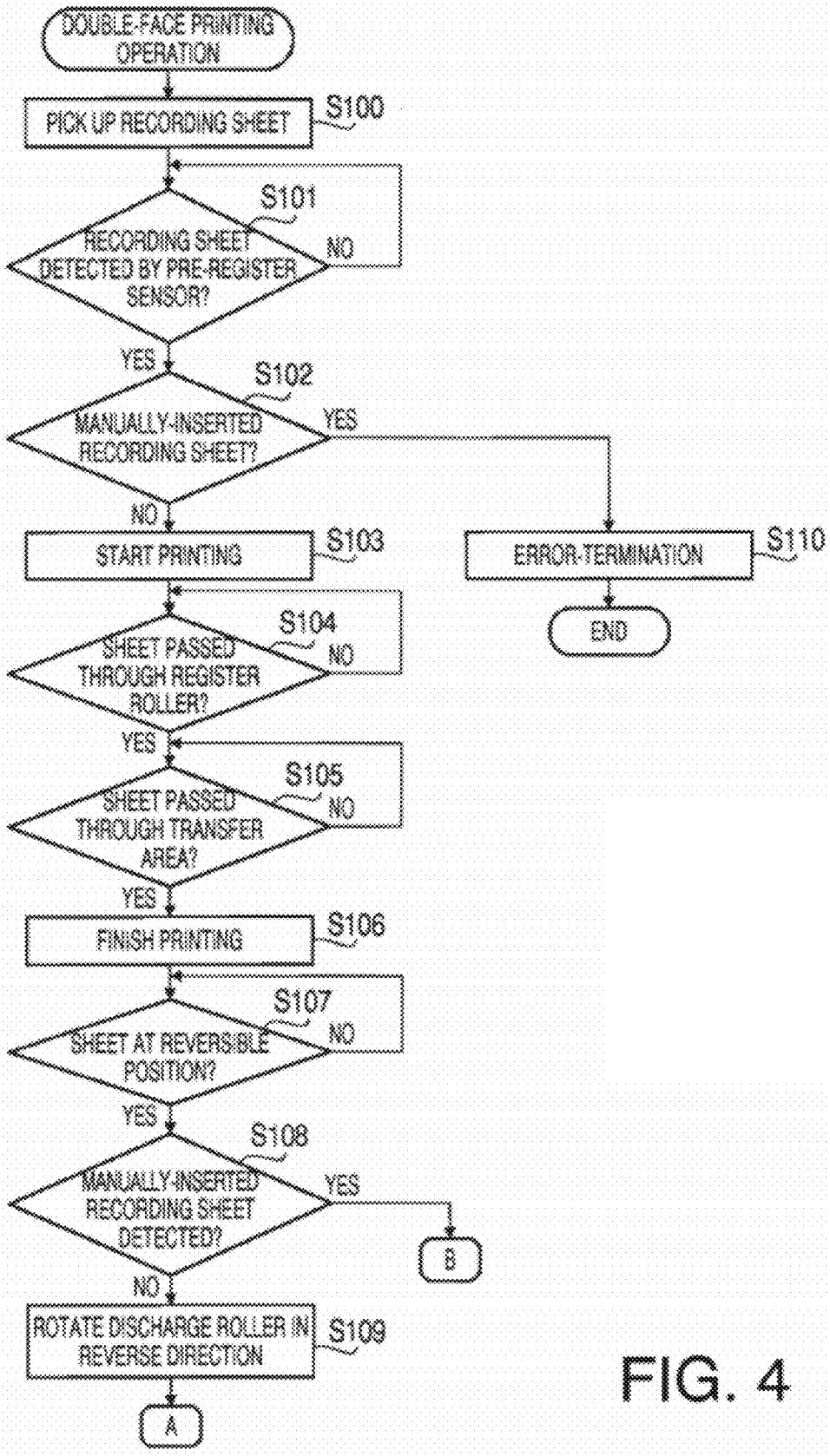
FIG. 4 is a first part of a flow of a double-face printing operation to be conducted in the printer according to the embodiments of the present invention.

As shown in FIG. 4, when the double-face printing operation starts, in S100, a recording sheet is picked up from the sheet cassette 91. In S101, it is determined as to whether a recording sheet reached the detectable range for the pre-register sensor 63 based on the signals output from the pre-register sensor 63. In other words, it is determined as to whether the pre-register sensor 63 detected a front end of a recording sheet. If no recording sheet is detected (S101: NO), the flow repeats S101 until the pre-register sensor 63 detects the recording sheet.

If a recording sheet is detected by the pre-register sensor 63 (S101: YES), in S102, it is judged as to whether the recording sheet is a manually-inserted recording sheet. If a front end of a recording sheet is detected by the pre-register sensor 63 prior to an estimated timing, at which the recording sheet picked up from the sheet cassette 91 is expected to reach the detectable range of the pre-register sensor 63 based on the speed to convey the recording sheet, it is determined that the recording sheet detected by the pre-register sensor 63 is a manually-inserted recording sheet, which is carried via a sheet path other than the feeding path 11, i.e., the manual sheet path 17. For example, if the pre-register sensor 63 detects a front end of a recording sheet after the sheet sensor 61 detected a front end of a recording sheet and before a predetermined period elapses, it is determined that the recording sheet detected by the pre-register sensor 63 is a manually-inserted recording sheet.

If the detected recording sheet is a manually-inserted recording sheet (S102: YES), the manually-inserted recording sheet may collide with the preceding recording sheet, which was picked up from the sheet cassette 91 in S100. Therefore, in S110, conveyance of the recording sheets is terminated ("error-termination"), and the double-face printing operation is aborted. When the double-face printing operation is error-terminated, the preceding recording sheet and the manually-inserted recording sheets are required to be removed by a user. If the recording sheet detected by the pre-register sensor 63 is not a manually-inserted recording sheet, that is, the detected recording sheet is the recording sheet picked up in S100 (S102: NO), in S103, printing an image on a first side of the recording sheet starts.

Following S103, in S104, it is judged as to whether the recording sheet with the image printed on the first side thereof passed through the register roller 73. In other words, it is judged as to whether a predetermined time period elapsed after a rear end of the recording sheet was detected by the pre-register sensor 63. If the recording sheet has not passed through the register roller 73 (S104: NO), the flow repeats S104 until the recording sheet passes through the register roller 73.

If the recording sheet has passed through the register roller 73 (S104: YES), in S105, it is judged as to whether the recording sheet has passed through a transfer area in the processing unit 50, in which the toner image is transferred onto a surface of the recording sheet. In other words, it is judged as to whether a predetermined time period elapsed after the post-register sensor 64 detected the rear end of the recording sheet. If the recording sheet has not passed through the transfer area (S105: NO), the flow repeats S105 until the recording sheet passes through the transfer area. If the recording sheet has passed through the transfer area (S105: YES), in S106, printing the image on the first side of the recording sheet is finished.

In S107, it is judged as to whether the recording sheet reached a reversible position, in which the recording sheet is nipped by the discharge roller 76, and the rear end of the recording sheet has passed through the branch point 15. In the reversible position, therefore, the direction of conveying the recording sheet can be switched, and the recording sheet starts being turned over to a reversed orientation. For example, it may be determined that the rear end of the recording sheet has passed through the branch point 15 if a predetermined time period elapsed after the rear end of the recording sheet was detected by the sheet sensor 65. If the recording sheet has not passed through the branch point 15 (S107: NO), the flow repeats S107 until the recording sheet reaches the reversible position.

If the recording sheet reached the reversible position (S107: YES), in S108, conveyance of the recording sheet is stopped, and it is judged as to whether a manually-inserted recording sheet is detected. For example, when the pre-register sensor 63 detects a recording sheet after the recording sheet passed through the register roller 73 and before the recording sheet is reversed, it is determined that the recording sheet detected by the pre-register sensor 63 is a manually-inserted recording sheet.

Figure 5:
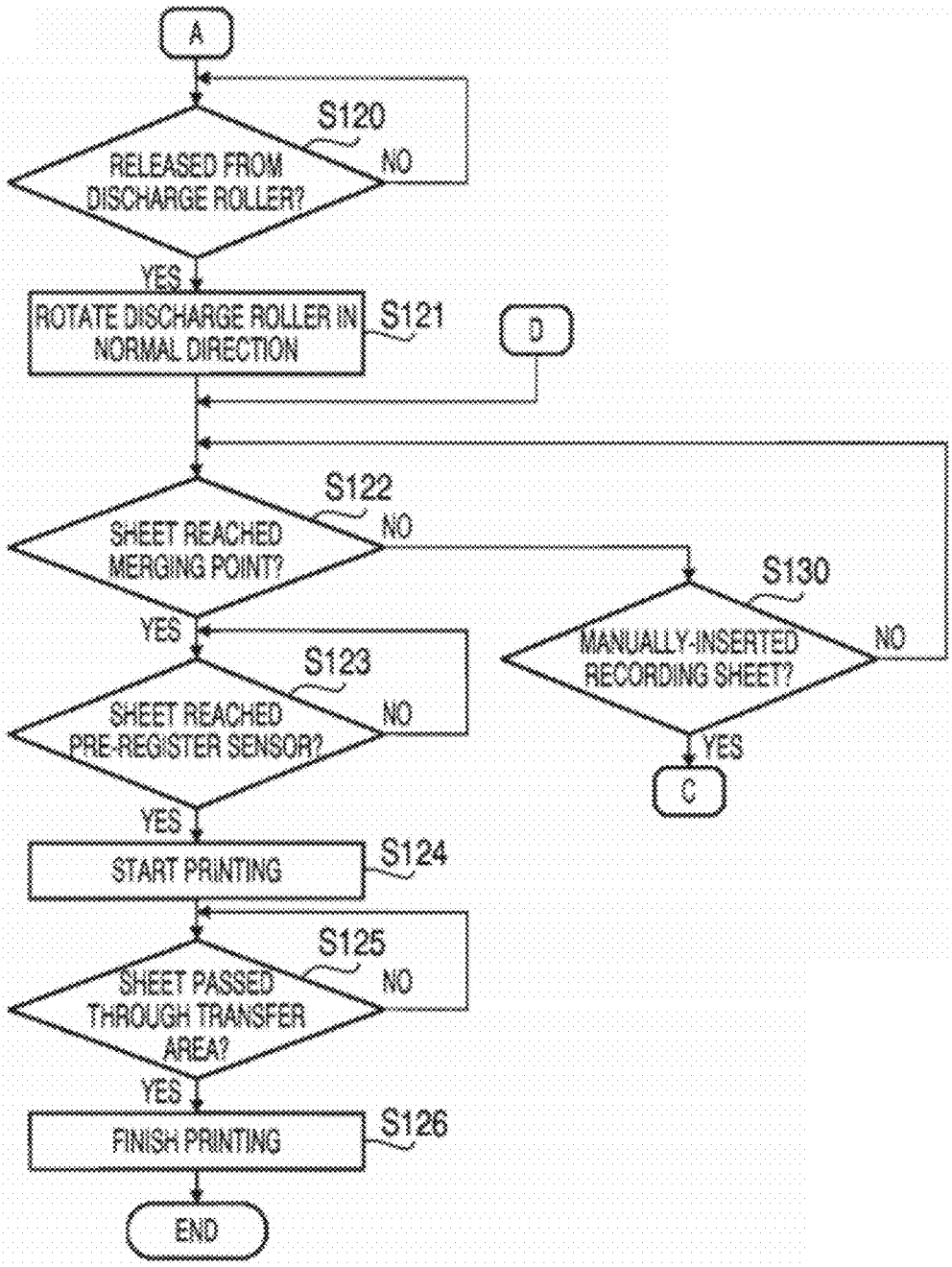
FIG. 5 is a second part of the flow of the double-face printing operation to be conducted in the printer according to the embodiments of the present invention.
Figure 6:
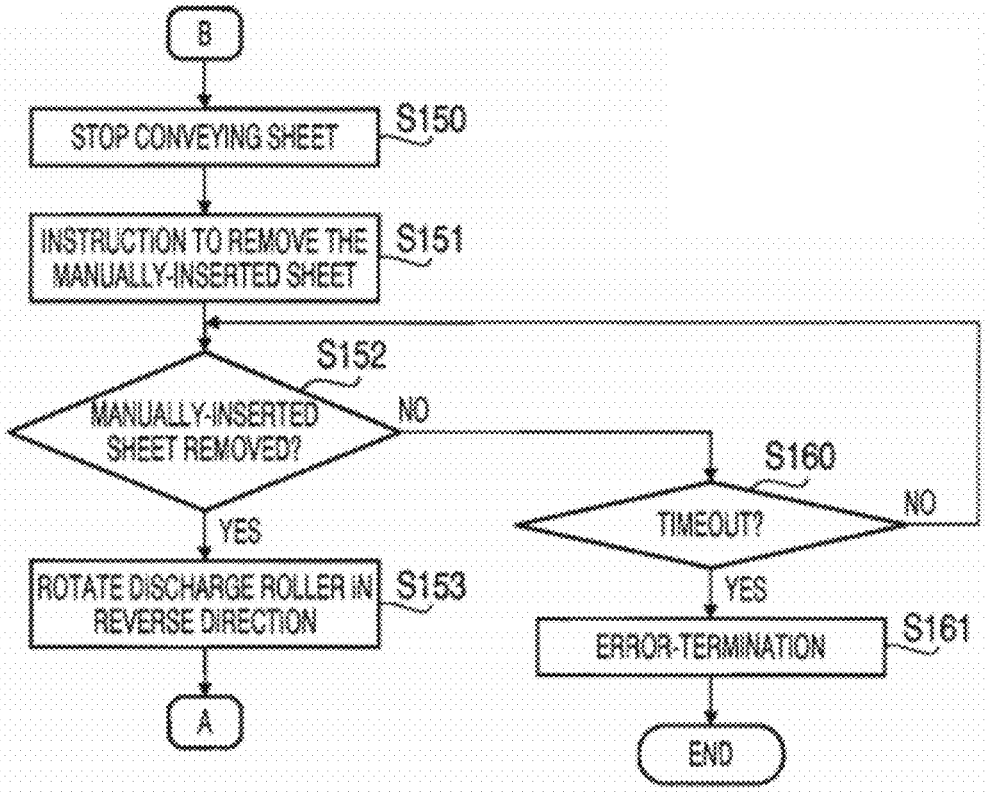
FIG. 6 is a third part of the flow of the double-face printing operation to be conducted in the printer according to the embodiments of the present invention.

If no manually-inserted recording sheet is detected (S108: NO), in S109, the discharge roller 76 is rotated in the reverse direction. Accordingly, the recording sheet in the reversible position is carried in the reverse direction and directed to the reversing path 13. The flow proceeds to S120 (FIG. 5). The flow following S120 will be described later in detail.

Meanwhile, in S108, if a manually-inserted recording sheet is detected (S108: YES), and if the preceding recording sheet in the reversible position is carried in the reverse direction in the reversing path 13, the preceding recording sheet may collide with the manually-inserted recording sheet being nipped by the register roller 73 when the preceding recording sheet returns to the feeding path 11 via the reversing path 13. In order to avoid the collision, the flow proceeds to S150 (FIG. 6), and conveyance of the preceding recording sheet is stopped. On the other hand, the manually-inserted recording sheet is maintained nipped by the register roller 73. In S151, a message to notify the user of presence of the redundant manually-inserted recording sheet and to instruct the user to remove the redundant manually-inserted recording sheet is displayed to the user via the display unit 41. The user may remove the manually-inserted recording sheet in accordance with the instruction.

In S152, it is determined as to whether the manually-inserted recording sheet has been removed. Removal (or presence) of the manually-inserted recording sheet can be determined based on the signals from the pre-register sensor 63. If the manually-inserted recording sheet remains (S152: NO), in S160, it is judged as to whether a timeout period elapsed. If the timeout period has not elapsed (S160: NO), the flow returns to and repeats S152 until the manually-inserted recording sheet is removed or the timeout period elapses. Once the timeout period elapses (S160: YES), in S161, conveyance of the recording sheets is error-terminated, and the double-face printing operation is aborted.

In S152, if the manually-inserted recording sheet has been removed (S152: YES), collision of the preceding recording sheet with the manually-inserted recording sheet is avoided, and the double-face printing operation is resumed. Therefore, in S153, the discharge roller 76 is rotated in the reverse direction. The flow proceeds to S120 (FIG. 5).

In S120, which follows S109 (FIG. 4) or S153 (FIG. 6), it is judged as to whether the preceding recording sheet is released from the discharge roller 76. Release of the recording sheet from the discharge roller 76 may be determined, for example, when a predetermined time period elapsed after the sheet sensor 67 detected the rear end of the recording sheet. If the recording sheet is not released from the discharge roller 76 (S120: NO), the flow repeats S120 until the recording sheet is released from the discharge roller 76. If the recording sheet is released from the discharge roller 76 (S120: YES), in S121, rotation of the discharge roller 76 is switched in order for the discharge roller 76 to start rotating in the normal direction. The recording sheet is conveyed in the reversing path 13 and returns to the feeding path 11.

In S122, it is judged as to whether the recording sheet returning in the reversing path 13 reaches the merging point 18. It may be determined that the recording sheet in the reversing path 13 reaches the merging point 18 when, for example, a predetermined time period elapsed after the sheet sensor 69 had detected the front end of the recording sheet. If the recording sheet has not reached the merging point 18 (S122: NO), in S130, it is judged as to whether a manually-inserted recording sheet is detected. If no manually-inserted recording sheet is detected (S130: NO), the flow returns to S122.

In S130, if a manually-inserted recording sheet is detected (S130: YES), the preceding recording sheet may collide with the manually-inserted recording sheet being nipped by the register roller 73 when the preceding recording sheet returns to the feeding path 11 via the reversing path 13. In order to avoid the collision, the flow proceeds to S170 (FIG. 7), and conveyance of the preceding recording sheet is stopped. In S171, a message to notify the user of presence of the redundant manually-inserted recording sheet and to instruct the user to remove the redundant manually-inserted recording sheet is displayed to the user via the display unit 41. The user may remove the manually-inserted recording sheet in accordance with the instruction.

In S172, it is determined as to whether the manually-inserted recording sheet has been removed. Removal (or presence) of the manually-inserted recording sheet can be determined based on the signals from the pre-register sensor 63. If the manually-inserted recording sheet has been removed (S172: YES), collision of the preceding recording sheet with the manually-inserted recording sheet is avoided, and the double-face printing operation is resumed. Therefore, in S173, conveyance of the preceding recording sheet is resumed. The flow proceeds to S122 (FIG. 5).

Meanwhile, if the manually-inserted recording sheet remains (S172: NO), in S180, it is judged as to whether a timeout period elapsed. If the timeout period has not elapsed (S180: NO), the flow returns to and repeats S172 until the manually-inserted recording sheet is removed or the timeout period elapses. If the timeout period elapses (S180: YES), in S181, the manually-inserted recording sheet nipped by the register roller 73 is drawn in and through the main unit 10 and directed along the printing path 14 to be forcibly ejected out of the printer 100. Therefore, the manually-inserted recording sheet is ejected ahead of the preceding recording sheet. The ejected manually-inserted recording sheet is settled in the discharge tray 96.

In S182, it is judged as to whether the manually-inserted recording sheet has been successfully ejected. Forcible ejection of the recording sheet may be determined based on a predetermined period, within which the recording sheet is assumed to pass through the detectable area of the sheet sensor 67. Additionally, for example, when the sheet sensor 67 detects the manually-inserted recording sheet passing through the detectable range of the sheet sensor 67 within the predetermined period, it is determined that the manually-inserted recording sheet is ejected successfully. On the other hand, the sheet sensor 67 does not detect the manually-inserted recording sheet passing through the detectable range of the sheet sensor 67 within the predetermined period, it is determined that forcible ejection of the manually-inserted recording sheet failed. Once the rear end of the manually-inserted recording sheet passes through the merging point 18, beyond which collision of the manually-inserted recording sheet with the preceding recording sheet is avoidable, concern for the preceding recording sheet about the collision with the manually-inserted recording sheet is cleared. Therefore, in S182, it may be determined that the manually-inserted recording sheet was successfully ejected when the rear end of the manually-inserted recording sheet passing through the merging point 18 is detected. More specifically, when the rear end of the manually-inserted recording sheet passing through the detectable range of the pre-register sensor 63, which is in the downstream position with respect to the merging point 18 and in a position closest to the merging point 18, is detected, it may be determined that the manually-inserted recording sheet was successfully ejected. Based on the judgment, conveyance of the preceding recording sheet may be resumed earlier. In any way, once the manually-inserted recording sheets exits a range, in which the manually-inserted recording sheet may collide with the preceding recording sheet, conveyance of the preceding recording sheet can be resumed.

In S182, if forcible ejection of the manually-inserted recording sheet failed (S182: NO), in S183, conveyance of the preceding recording sheet is error-terminated, and the double-printing operation is aborted. If the manually-inserted recording sheet has been successfully ejected (S182: YES), collision of the preceding recording sheet with the manually-inserted recording sheet is avoided, and the double-face printing operation is resumed. Therefore, in S173, conveyance of the preceding recording sheet is resumed. The flow proceeds to S122 (FIG. 5).

In S122, if the preceding recording sheet returning in the reversing path 13 reaches the merging point 18 (S122: YES), in S123, it is judged as to whether the recording sheet reaches the detectable range of the pre-register sensor 63, that is, whether the pre-register sensor 63 detects the front end of the recording sheet. If the recording sheet does not reach the detectable range of the pre-register sensor 63 (S123: NO), the flow repeats S123 until the recording sheet is detected by the pre-register sensor 63.

If the recording sheet reaches the detectable range of the pre-register sensor 63 (S123: YES), in S124, printing an image on a second side of the recording sheet returned in the feeding path 11 starts. In S125, it is judged as to whether the recording sheet has passed through the transfer area in the processing unit 50. In other words, it is judged as to whether the predetermined time period elapsed after the post-register sensor 64 detected the rear end of the recording sheet. If the recording sheet has not passed through the transfer area (S125: NO), the flow repeats S125 until the recording sheet passes through the transfer area.

If the recording sheet has passed through the transfer area (S125: YES), in S126, printing the image on the second side of the recording sheet is finished. Thus, the double-face printing operation is completed.

Double-Face Printing Operation (Second Example)

Figure 7:
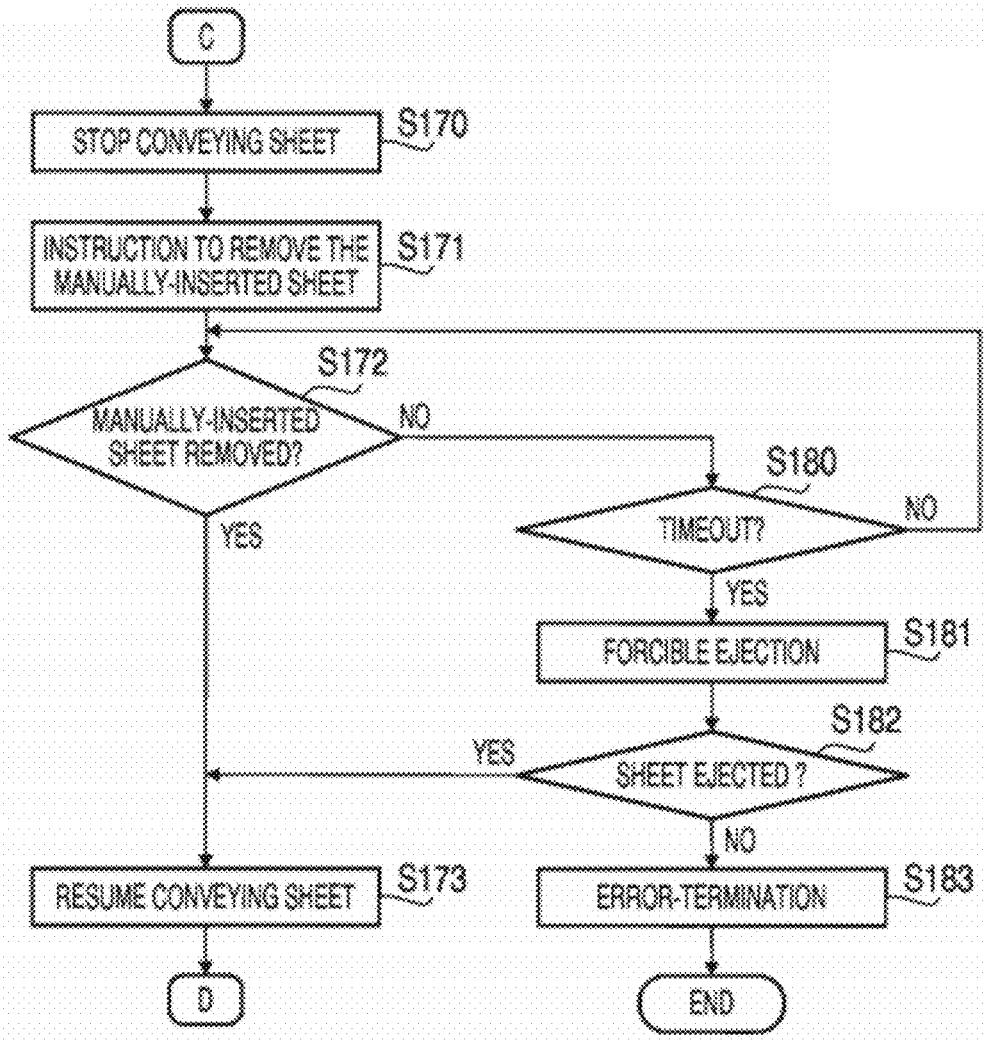
FIG. 7 is a fourth part of the flow of the double-face printing operation to be conducted in the printer according to a first embodiment of the present invention.
Figure 8:
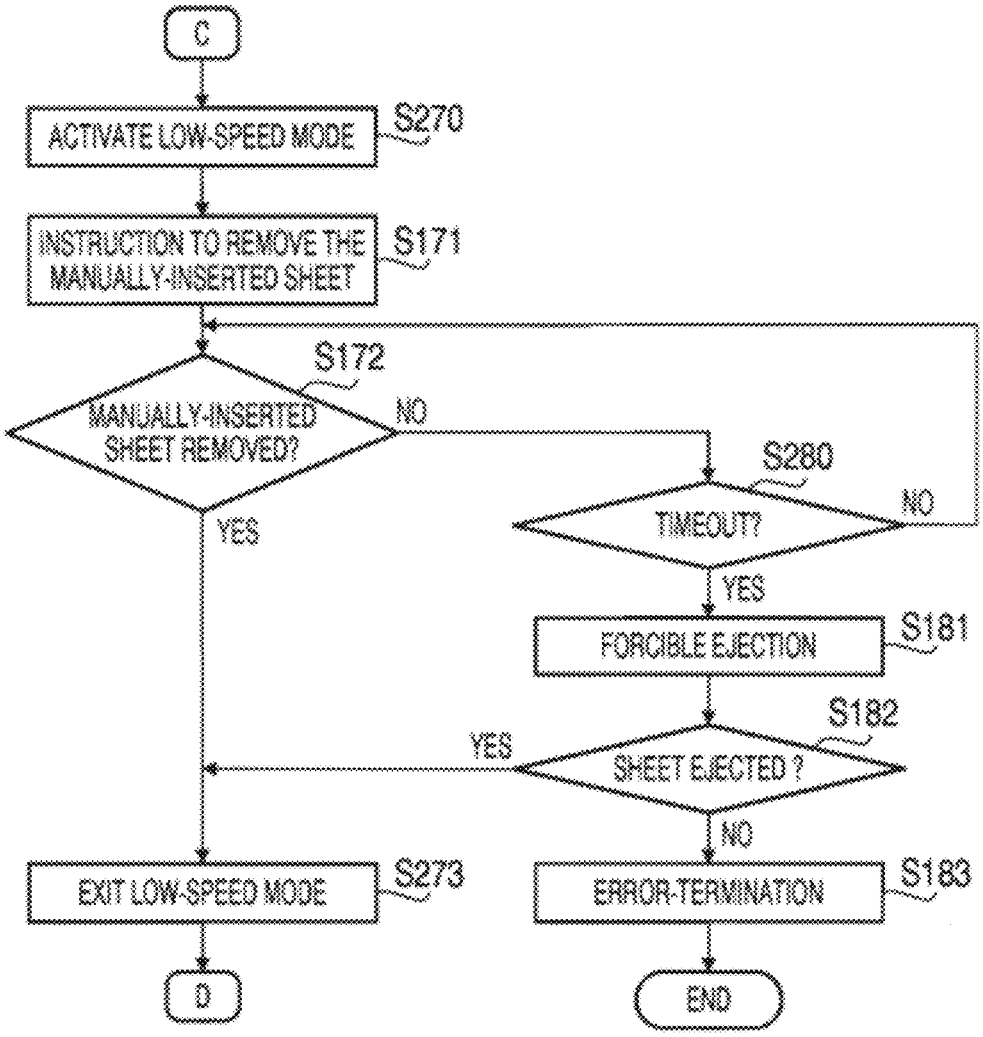
FIG. 8 is a part of a flow of the double-face printing operation to be conducted in the printer according to a second embodiment of the present invention.

Behaviors of the printer 100 in a double-face printing operation according to a second embodiment of the present invention will be described with reference to a flowchart shown in FIG. 8. In the double-printing operation in the second example, when a manually-inserted recording sheet is detected, the printer 100 enters a low-speed mode, in which a speed to convey the preceding recording sheet is lowered. In the flowchart shown in FIG. 8, a flow following detection of a manually-inserted recording sheet (FIG. 5, S130: YES), whilst a preceding recording sheet is in the reversing path 13, is different from the flows described in the first embodiment. In other words, the flows of the behaviors of the printer 100 in the double-face printing operation shown in FIG. 7 are replaced with steps shown in FIG. 8 in the second embodiment. Therefore, in the following description, the flows of steps to replace those in FIG. 7 will be described in detail, and description of the common steps shown in FIGS. 4-6 will be omitted.

In S130 (FIG. 5), if a manually-inserted recording sheet is detected (S130: YES), the flow proceeds to S270. In S270, the printer 100 enters a low-speed mode, in which a speed to convey the preceding recording sheet is lowered than an initial normal conveying speed. In the low-speed mode, by conveying the recording sheet in the reduced speed, extra time for the manually-inserted recording sheet to be removed out of the printing path 14 is created. Thus, collision of the preceding recording sheet with the manually-inserted recording sheet is avoided. The reduced speed in the low-speed mode may be a fixed speed or may be varied according to a distance between the merging point 18 and the preceding recording sheet at the timing, at which the manually-inserted recording sheet is detected. Therefore, when the distance between the merging point 18 and the preceding recording sheet is smaller, the conveying speed may be lower. Following S270, in S171, a message to notify the user of presence of the redundant manually-inserted recording sheet and to instruct the user to remove the redundant manually-inserted recording sheet is displayed to the user via the display unit 41. The user may remove the manually-inserted recording sheet according to the instruction.

In S172, it is judged as to whether the manually-inserted recording sheet has been removed. If the manually-inserted recording sheet has been removed (S172: YES), in S273, the printer 100 exits the low-speed mode, and the speed to convey the recording sheet is increased, for example, to the initial conveying speed. The flow proceeds to S122 (FIG. 5).

Meanwhile, if the manually-inserted recording sheet remains (S172: NO), in S280, it is judged as to whether a timeout period elapsed. A length of the timeout period may be fixed or varied according to the distance between the merging point 18 and the preceding recording sheet at the timing, at which the manually-inserted recording sheet is detected. Therefore, when the distance between the merging point 18 and the preceding recording sheet is smaller, the timeout period may be shorter. If the timeout period has not elapsed (S280: NO), the flow returns to and repeats S172 until the manually-inserted recording sheet is removed or the timeout period elapses. If the timeout period elapses (S280: YES), in S181, the manually-inserted recording sheet nipped by the register roller 73 is drawn in and through the main unit 10 and directed along the printing path 14 to be forcibly ejected out of the printer 100. Therefore, the manually-inserted recording sheet is ejected ahead of the preceding recording sheet. The ejected manually-inserted recording sheet is settled in the discharge tray 96.

In S182, it is judged as to whether the manually-inserted recording sheet has been successfully ejected. If forcible ejection of the manually-inserted recording sheet failed (S182: NO), in S183, conveyance of the preceding recording sheet is error-terminated, and the double-printing operation is aborted. If the manually-inserted recording sheet has been successfully ejected (S182: YES), that is, once the manually-inserted recording sheets exits a range, in which the preceding recording sheet may collide with the manually-inserted recording sheet, collision of the preceding recording sheet with the manually-inserted recording sheet is avoided, and the double-face printing operation is resumed. Therefore, in S273, the printer 100 exits the low-speed mode, and the speed to convey the recording sheet is increased to the initial conveying speed. The flow proceeds to S122 (FIG. 5).

According to the second embodiment, when the manually-inserted recording sheet is inserted during the double-face printing operation, extra time for the manually-inserted recording sheet to be removed out of the printing path 14, either by being removed by the user or by forcibly ejected, is created. Therefore, errors due to collision of the preceding recording sheet with the manually-inserted recording sheet can be avoided whilst the double-face printing with the preceding recording sheet is continued. Further, whilst conveyance of the recording sheet is not stopped but maintained, throughput per unit of time of the printer 100 according to the second embodiment can be greater than throughput of the printer 100 in the first embodiment, in which conveyance of the recording sheet is stopped. In other words, productivity of the printer 100 can be improved. Meanwhile, although the throughput per unit of time may be lower, it is to be noted that the printer 100 in the first embodiment does not require the complicated control of the conveying speed, as required in the printer 100 according to the second embodiment. Therefore, the printer 100 can be controlled in less complicated steps.

In the second embodiment, the once-reduced conveying speed in the low-speed mode is increased to the initial speed. However, the conveying speed may not necessarily be increased to the initial speed as long as the conveying speed after exiting the low-speed mode is faster than the conveying speed in the low-speed mode, and the productivity, which is once reduced by the lowered speed, is regained.

As has been described above, the printer 100 according to the embodiments of the present invention creates extra time, within which collision between the preceding recording sheet and the manually-inserted recording sheet can be avoided, by reducing and/or stopping the conveying speed when the manually-inserted recording sheet is detected during the double-face printing operation. Accordingly, errors due to collision of the preceding recording sheet with the manually-inserted recording sheet can be avoided, and the user's manual works such as removing the jammed sheets can be reduced. In this regard, reducing the conveying speed includes stopping conveyance of the recording sheet.

Although examples of carrying out the invention have been described, those skilled in the art will appreciate that there are numerous variations and permutations of the printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the present invention can be similarly effectively applied to other image forming apparatuses having a double-face printing system and a manual sheet-feeding mechanism such as a copier, a multifunction peripheral device, and a facsimile machine. Further, the image forming unit in the image forming apparatus may not necessarily form images electro-photographically, but may form in, for example, inkjets. Furthermore, the image forming apparatus may be either a multi-color image forming apparatus or a monochrome image forming apparatus.

For another example, the printer 100 may be equipped with a conveying system, such as conveyer rollers, to assist inserting the recording sheet in the manual sheet path 17 in order for the manually-inserted recording sheet to be forwarded in the manual sheet path 17 smoothly.

For another example, the merging point 18, at which the manual sheet path 17 merges into the feeding path 11, may not necessarily be arranged in the downstream position with respect to the merging point 16, at which the reversing path 13 merges into the feeding path 11 but may be arranged in an upstream position with respect to the merging point 16.

Further, the pre-register sensor 63 may not necessarily serve to detect the manually-inserted recording sheet directed in the manual sheet path 17, but a sheet sensor to specifically detect the manually-inserted recording sheet in the manual sheet path 17 may be provided. With the specifically dedicated sheet sensor, the manually-inserted recording sheet may be detected earlier than the pre-register sensor 63. Furthermore, with the specific sheet sensor, the manually-inserted recording sheet may be detected whilst the printer 100 waits for the preceding recording sheet to pass by the register roller 73 in S104 (FIG. 4). When the manually-inserted recording sheet is detected by the specific sheet sensor, conveyance of the recording sheets may be error-terminated.

For another example, during the printing operation to print an image on the first side of the recording sheet, judgment to determine presence of the manually-inserted sheet is performed when the recording sheet reaches the reversible position (FIG. 4, S107). However, the judgment may not necessarily be triggered by the recording sheet reaching the reversible position but may be made whenever the pre-register sensor 63 detects the manually-inserted recording sheet. In this case, the conveying speed to convey the preceding recording sheet may be reduced immediately after detection of the manually-inserted sheet. On the other hand, if the judgment is to be made when the recording sheet reaches the reversible position, when the user removes the manually-inserted recording sheet immediately after the insertion, necessity to lower the conveying speed is cleared, and the preceding recording sheet may be conveyed in the initial speed. Therefore, productivity of the printer 100 can be maintained.

In the embodiments described above, the conveying speed is lowered when the manually-inserted recording sheet is detected whilst the reversed preceding recording sheet is in the reversing path 13. However, the conveying speed may be reduced when the manually-inserted recording sheet is detected whilst the preceding recording sheet is in the printing path 14. In this case, it is likely that the preceding recording sheet is in the discharge path 12; therefore, it is preferable that forcible ejection of the manually-inserted recording sheet after the timeout period is omitted. Further, changing the conveying speeds whilst the preceding recording sheet is in the processing unit 50 may undesirably affect an outcome and quality of the printed image. Therefore, it is preferable that the conveying speed is not changed and reduction of the speed to convey the preceding recording sheet is canceled whilst the preceding recording sheet is in the processing unit 50.

For another example, the printer 100 may not necessarily convey a single recording sheet at a time to print the first image on the first side and the second image on the second side sequentially. A plurality of (e.g., two) recording sheets may be in the printer 100 at a time, and a first image may be printed on a first side of a succeeding recording sheet in the printing path 14 whilst a preceding recording sheet with a first image printed on a first side thereof is in the reversing path 13. In other words, first images may be printed sequentially on first sides of a plurality of recording sheets. In the printer 100 configured as above, the succeeding recording sheet may not necessarily wait for the preceding recording sheet to be ejected but may be efficiently fed in the printing path 14 before the preceding recording sheet is ejected. In other words, the recording sheets may be fed in shorter intervals, and productivity of the printer 100 can be improved.

Figure 9:
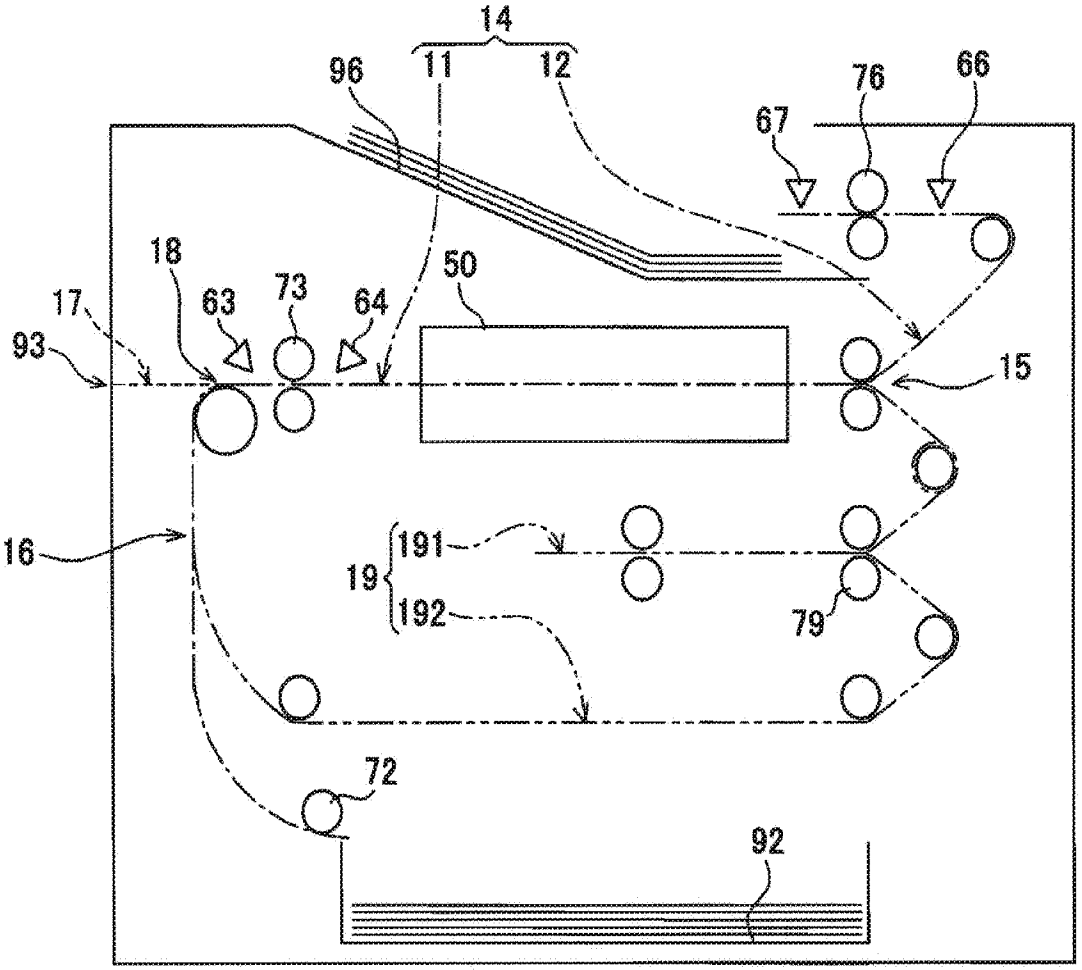
FIG. 9 is a schematic diagram to illustrate an internal configuration of another example of the printer according to the embodiments of the present invention.

Further, the discharge roller 76 may not necessarily serve to reverse the recording sheet, but a specific reversing roller 79 (see FIG. 9) may be provided. For example, as shown in FIG. 9, the reversing path 19 may have a switchback path 191, in which the recording sheet is turned over, and a returning path 192, along which the recording sheet turned over in the switchback path 191 is guided to the feeding path 11. In a double-face printing operation, the recording sheet with the first image printed on the first side is carried in the switchback path 191 via the branch point 15. In this regard, the reversing roller 79 rotates in a normal direction. When the recording sheet is carried in the switchback path 191 with its rear end portion nipped by the reversing roller 79, rotation of the reversing roller 79 is switched to a reverse direction. According to the reverse rotation, the recording sheet is guided in the returning path 192 and returns to the feeding path 11 via the merging point 16. In this regard, the second side of the recording sheet comes to face the processing unit 50 to have the second image printed thereon. With this reversing configuration, the discharge roller 76 may not necessarily be rotatable in the normal and reverse directions but may be rotatable solely in the normal direction. According to the above-described configuration, the recording sheet starts to be reversed at the branch point 15, at which the discharge path 12 and the reversing path 19 diverge.

What is claimed is:

1. A printing apparatus capable of double-sided printing, comprising:

a printing unit configured to print an image on one of two sides of a first recording sheet;

a sheet feeder configured to feed the first recording sheet to the printing unit;

a discharge unit configured to settle the first recording sheet with the image printed thereon;

a sheet path comprising:

a feeding path configured to guide the first recording sheet from the sheet feeder to the printing unit, a discharge path configured to guide the first recording sheet through the printing unit to the discharge unit, and a reversing path divergent from the discharge path, the reversing path merging into the feeding path at a first position upstream from the printing unit, the reversing path configured to reverse the first recording sheet during a double-sided printing operation;

a manual sheet inlet configured to receive a second recording sheet manually inserted by a user;

a manual sheet path that merges into the sheet path at a merging point upstream from the printing unit, the manual sheet guiding the second recording sheet to the merging point;

a detecting unit configured to detect the manual sheet inlet receiving the second recording sheet manually inserted by a user;

a processor; and non-transitory memory storing computer-readable instructions that, when executed by the processor, cause the apparatus to:

detect the manual sheet inlet receiving the second recording sheet while the double-sided printing operation is being performed with the first recording sheet, determine whether the detecting unit detected the second recording sheet, and change a speed of conveying the first recording sheet in the sheet path from a first speed to a second speed, the second speed slower than the first speed and greater than zero, the change being performed in response to determining that the detecting unit detected the second recording sheet.

2. The printing apparatus according to claim 1, the non-transitory memory storing further computer-readable instructions that, when executed by the processor, cause the apparatus to:

detect that the second recording sheet is removed from the manual sheet inlet, and change the speed of the first recording sheet from the second speed to the first speed in response to detecting that the second recording sheet is removed from the manual sheet inlet.

3. The printing apparatus according to claim 1, the non-transitory memory storing further computer-readable instructions that, when executed by the processor, cause the apparatus to:

detect that the first recording sheet is being reversed, wherein changing the speed of conveying the first recording sheet from the first speed to the second speed is further in response to detecting that the first recording sheet has begun to be reversed.

4. The printing apparatus according to claim 1, the non-transitory memory storing further computer-readable instructions that, when executed by the processor, cause the apparatus to:

detect that the printing unit is printing the image, and change the speed of the first recording sheet from the second speed to the first speed in response to detecting that the printing unit is printing the image.

5. The printing apparatus according to claim 1, the non-transitory memory storing further computer-readable instructions that, when executed by the processor, cause the apparatus to:

guide the second recording sheet to the discharge unit without directing the second recording sheet to the reversing path, ahead of the first recording sheet, the guiding being performed in response to determining that the detecting unit detected the second recording sheet.

6. The printing apparatus according to claim 5, the non-transitory memory storing further computer-readable instructions that, when executed by the processor, cause the apparatus to:

detect that the second recording sheet passed a second position, wherein after the second position, a collision between the second recording sheet and the first recording sheet is avoidable, and change the speed of the first recording sheet from the second speed to the first speed in response to detecting that the second recording sheet passed the second position.

7. The printing apparatus according to claim 6, wherein detecting that the second recording sheet passed the second position comprises detecting that a rear end of the second recording sheet passed by the merging point.

8. The printing apparatus according to claim 1, the non-transitory memory storing further computer-readable instructions that, when executed by the processor, cause the apparatus to:

notify the user, with a notification, the second recording sheet in response to detecting the manual sheet inlet receiving the second recording sheet, the notification comprising instructions for the user to remove the second recording sheet.

9. A printing apparatus comprising:

a sheet storage configured to store a recording sheet;

a printing unit configured to print an image on one of two sides of the recording sheet;

a pick-up unit configured to pick up the recording sheet from the sheet storage;

a discharge unit configured to discharge the recording sheet;

a conveyer comprising:

a first conveyer configured to convey the recording sheet from the pick-up unit to the printing unit, a second conveyer configured to convey the recording sheet through the printing unit to the discharge unit, and a reversing conveyer configured to diverge from the second conveyer and merge into the first conveyer at a merging point, the reversing conveyer further configured to reverse the recording sheet during a double-face printing operation;

a sheet inlet is configured to receive a different recording sheet inserted in the printing apparatus;

a third conveyer configured to merge into the first conveyer at the merging point, the third conveyer conveying the different recording sheet from the sheet inlet to the merging point;

a detector configured to detect the different recording sheet being received by the sheet inlet;

a processor; and non-transitory memory storing computer-readable instructions that, when executed by the processor, cause the apparatus to:

change a speed of the recording sheet in the conveyer from a first speed to a second speed, the second speed slower than the first speed and greater than zero, the change being performed in response to the detector detecting the different recording sheet being received by the sheet inlet while the conveyer is conveying the recording sheet.

10. The printing apparatus according to claim 9, wherein the conveyer conveying the recording sheet comprises the reversing conveyer reversing the recording sheet during a double-face printing operation.

11. The printing apparatus according to claim 9, the non-transitory memory storing further computer-readable instructions that, when executed by the processor, cause the apparatus to:

detect that the printing unit is printing the image, and change the speed of the recording sheet from the second speed to the first speed in response to detecting that the printing unit is printing the image.

* * * * *